US005683254A

United States Patent [19]

Lin

[11] Patent Number: 5,683,254

[45] Date of Patent: Nov. 4, 1997

[54] SWIVEL PLUG STRUCTURE WITH A BULB SOCKET

[76] Inventor: Chiu-Chen Lin, P.O. Box 96-405, Taipei 10098, Taiwan

[21] Appl. No.: 582,090

[22] Filed: Jan. 2, 1996

[51] Int. Cl.[6] ..... H01R 39/00

[52] U.S. Cl. ..... 439/11; 439/647; 362/226

[58] Field of Search ..... 439/11, 31, 640, 439/647, 655, 534; 362/226, 287

[56] References Cited

U.S. PATENT DOCUMENTS

| | | | |
|---|---|---|---|
| 2,292,038 | 8/1942 | Benander | 439/647 |
| 3,092,695 | 6/1963 | Abrams | 439/11 |
| 4,931,911 | 6/1990 | Hanson | 362/226 |

*Primary Examiner*—Gary F. Paumen
*Attorney, Agent, or Firm*—Bacon & Thomas

[57] ABSTRACT

A swivel plug structure with a bulb socket, in which the bottom surface of the socket body has two symmetrical semi-circular slots; one end of each semi-circular slot has a through slot, while other end of the semi-circular slot has a stop flange. One end of the swivel base 14 has two copper plugs, while the other end thereof has two symmetrical hook members on the disk member thereof; the hook members are to be plugged through two through slots respectively in the socket body so as to have the swivel base and the socket body connected together. An outer cover has two symmetrical stop posts, of which the lower ends are set on the semi-circular slot nearing the through slots respectively; the stop post is used for stopping of, and limiting the turning angle of the hook member.

3 Claims, 4 Drawing Sheets

SWIVEL PLUG STRUCTURE WITH A BULB SOCKET

BACKGROUND OF THE INVENTION

1. Field of the Invention

This invention relates to a plum structure, and particularly to a swivel plum structure with a bulb socket.

2. Description of the Prior Art

In the conventional wall lamp, the two copper plums and the socket body are made into one piece; such copper plums are usually limited with the installation direction of the power outlet, i.e., an ornament on the upper end or outer end of the socket body is unable to set upwards as it should.

There is a conventional plug structure, which was used in a liquid type of mosquito smudge heated with an electric heater. The heater is mounted in an upper body portion and a lower body portion; each of the two body portions has semi-circular opening. A plug base has two copper plugs and a disk-shaped member, which is fitted in an opening formed with the two semi-circular openings. The plug base and body portion can be turned at an angle of 90 degrees relatively. When the liquid type of mosquito smudge is inserted in a power outlet on a wall, the plum structure would not affected by the position of the power outlet so as to maintain the mosquito smudge always in vertical position.

SUMMARY OF THE INVENTION

The prime object of the present invention is to provide a plug structure, of which the bottom surface of the socket body has two symmetrical semi-circular slots to be engaged with two hook members on the swivel base respectively; both ends of each semi-circular slot are furnished with a stop flange and a stop post respectively so as to have the swivel base turned at an angle of 90 degrees, and to maintain the socket body always in vertical position.

Another object of the present invention is to provide a plug structure, in which the bottom surface of the socket body has two symmetrical semi-circular slots; one end of each semi-circular slot has a through slot for receiving the hook member; after the hook member passing through the through slot, the neck portion of the hook member will be engaged in the semi-circular slot to provide a positioning function with the hook.

Still another object of the present invention is to provide a plug structure, in which the outer cover has two stop posts extended in a space between the semi-circular slot and the through slot for preventing the hook members from being disengaged from the semi-circular slots.

A further object of the present invention is to provide a plug structure, in which the two stop posts of the outer cover each have a reinforced rib in contact with the inner surface of the socket body; the reinforced rib is used to increase the strength of the stop post.

A still further object of the present invention is to provide a plug structure, in which the two copper plugs are connected with two power wires, which pass through a round hole in the bottom surface, and extend to two copper bars respectively; the power wires will not be affected upon the swivel base being turned.

DETAILED DESCRIPTION OF THE PREFERRED EMBODIMENT

Figure 2:
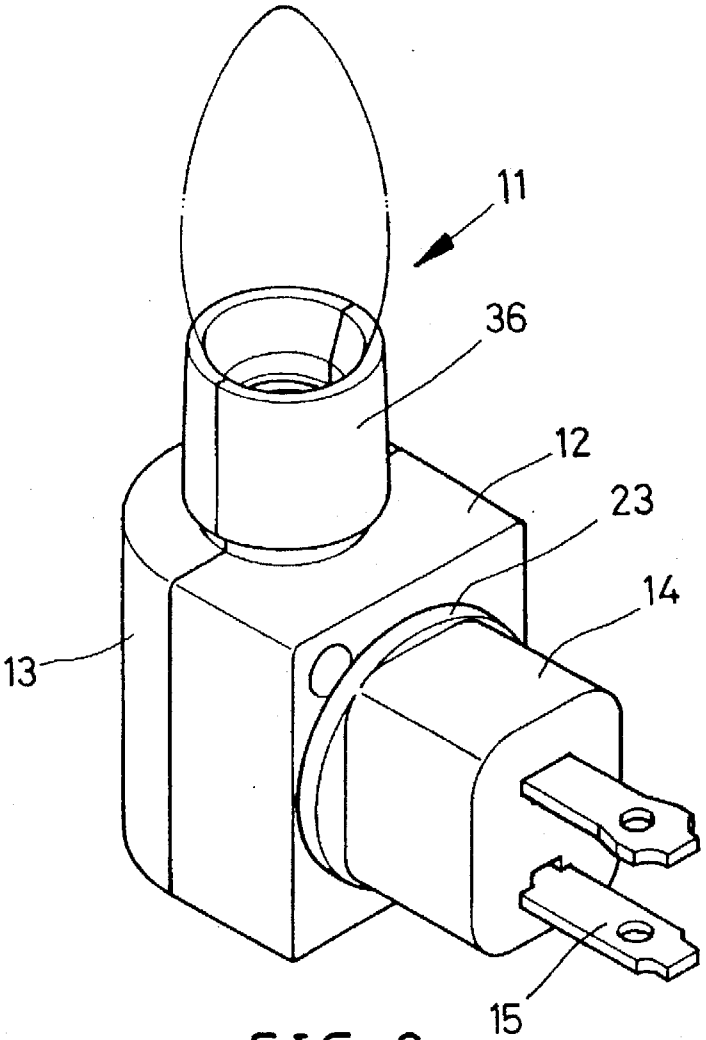
FIG. 2 is a perspective view of the present invention, showing the swivel base set in another direction.
Figure 1:
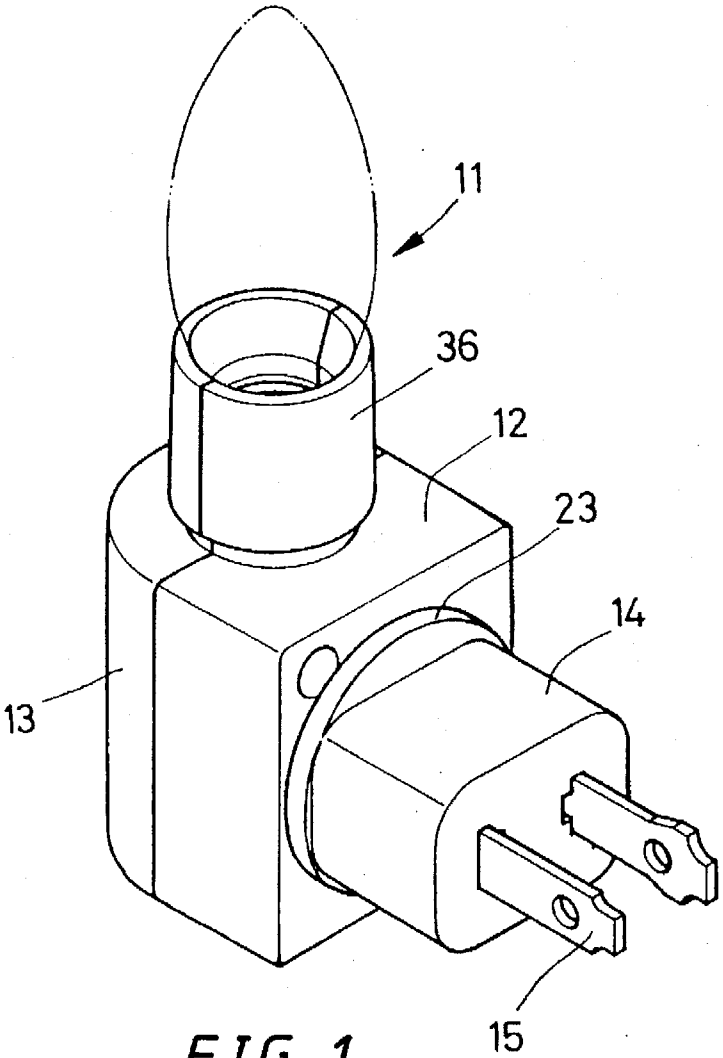
FIG. 1 is a perspective view of an embodiment according to the present invention, showing the swivel base set in one direction.
Figure 3:
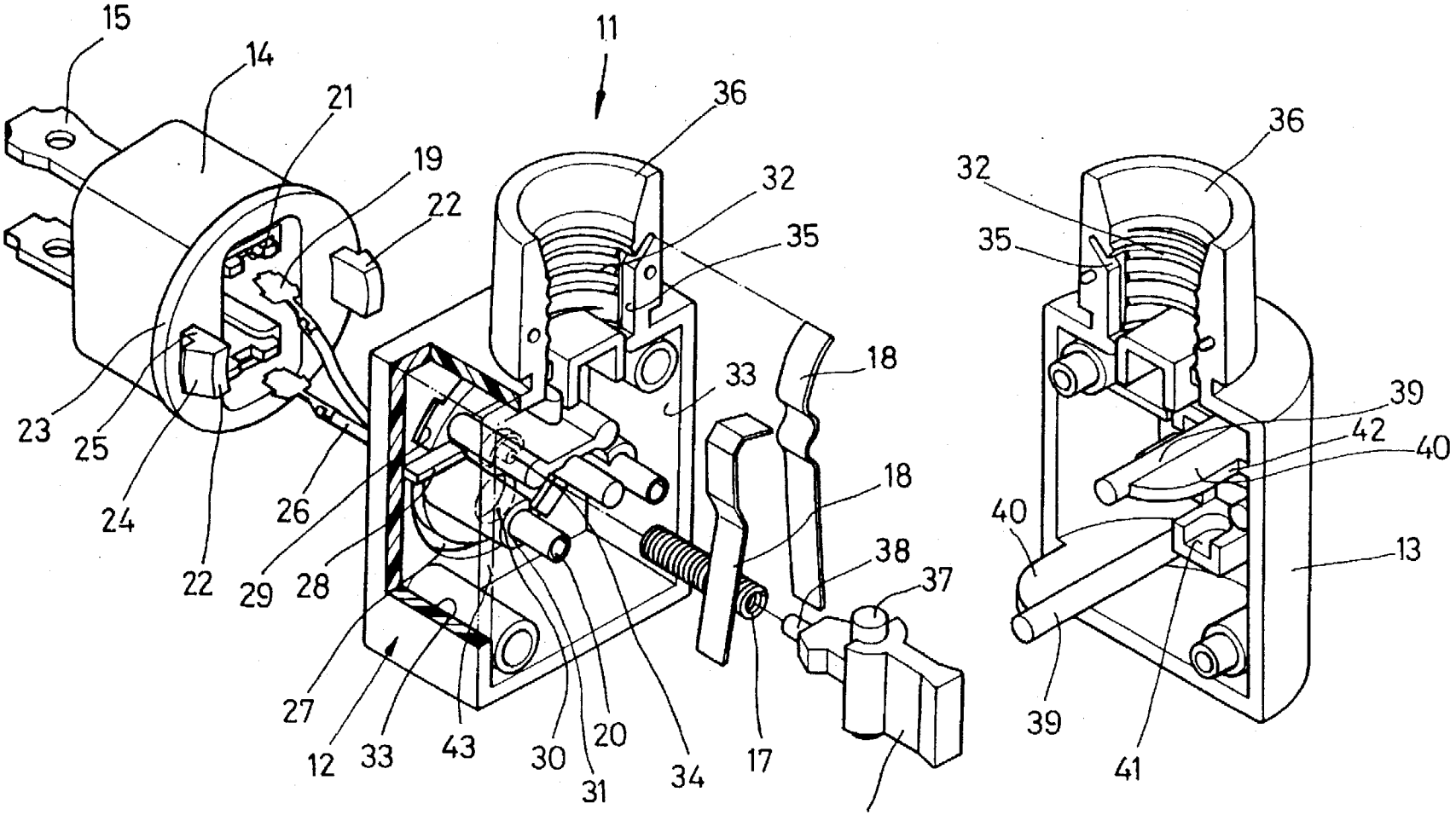
FIG. 3 is a disassembled view of the present invention, showing the structure of the whole lamp socket.

Referring to FIGS. 1 to 3, the swivel base of present invention is to be used in the lamp socket 11 of a wall lamp; the lamp socket 11 includes a socket body 12, an outer cover 13, and a bulb socket 36 extended out of the outer cover; a copper contact seat 36 in the bulb socket 36 is used for mounting a bulb copper contactor 18. A bulb is to be fitted in the threads 32 of the bulb socket 36 so as to become contacted with two bulb copper contactors 18. A switch 16 in the lower part of the bulb socket 36 is used for controlling the power supply of the lamp. The bottom surface 43 of the socket body 12 is pivotally connected with a swivel base 14 able to turn at an angle of 90 degrees so as to adapt to the power outlet on a wall no matter the two holes in the power outlet are arranged horizontally or vertically.

Referring to FIG. 3 to 6, the socket body 12 is a square-shaped member with an opening side, which is to be covered with an outer cover 13 before being fastened together with screws. The center of the bottom surface 43 of the socket body 12 has a positioning seat 34 for receiving one end of the spring 17, while the other end of the spring 17 is mounted on a short stud 38 of the switch 16. Both sides of the switch 16 are furnished with two mounting shafts 37 respectively mounted in two shaft seats 41 in the outer cover 13 respectively. The outer control plate of the switch 16 extends out of the outer cover 13. The lower side of the positioning seat 34 has a round hole 30, of which both sides are furnished with two symmetrical copper bar holes 31 respectively. The round hole 30 is used for receiving two power wires 26. The copper bar holes 31 are used for fitting two copper bars 20 connected with two power wires 26 respectively. The two copper bars 20 are to be in contact with the lower ends of the two bulb copper contactors 18 respectively. One of the two bulb copper contactors is controlled with the switch 16, i.e., to control the power supply for the bulb.

The outer edge of the copper bar holes 31 on the bottom surface 43 is furnished with two symmetrical semi-circular slots 27, which are through slots for assembling the swivel base 14 with the socket body. One end of each semi-circular slot 27 has a stop flange 28 to separate the two semi-circular slots. One end of each semi-circular slot nearing the stop flange 28 has a through slot 29 to be mated with a hook member 22 on the swivel base 14; therefore, the swivel base 14 is limited at a given angle.

One end of the swivel base 14 has a disk member 23, of which the edge is furnished with two symmetrical hook members 22; the other end of the swivel base 14 is provided with two copper plugs 15; the other end of the copper plug 15 is fastened in a copper contact slot 21, whereby the copper plugs 15 and the swivel base can be assembled together. The copper contact slots 21 are to be plugged in with two copper contacts 19 of the two power wires 26 respectively; the power wires 26 pass through the round hole 30 in the bottom surface 43, and extended into the socket body 12. The edge of the disk member 23 is furnished with two symmetrical hook member 22. The hook member 22 includes a neck portion 25 and a hook 24; the height of the neck portion 25 is equal to or slightly larger than that of the bottom surface 43 of the socket body 12. The hook 24 extends at one side of the neck portion 25. The two hook members 22 on the swivel base 14 pass through the two through slots 29 at ends of the two semi-circular slots 27, and then turn so as to enter the two semi-circular slots 27 respectively. When the neck portion 25 moves along the semi-circular slot 27, the swivel base 14 will move simultaneously as a result of the hook 24 engaged on the outer surface of the semi-circular slot 27.

After the swivel base 14 and the bottom surface 43 of the socket body 12 are assembled together, ends of the two power wires 26 are connected with the two copper bars 20 in the socket body 12; the two copper bars 20 are in contact with the lower end of the two bulb copper contactors 18. The opening side of the socket body 12 is to be engaged together with the outer cover 13 before being fixed in place with screw. After the two copper plugs 15 are plugged into a power outlets the switch 16 outside the outer case 13 can be used to switch the power supply of the bulb socket 36.

The swivel base 14 and the socket body 12 are assembled together after plugging and turning; in order to prevent the swivel base 14 and the socket body 12 are separated, the outer cover 13 has two stop posts 39 extended to a space between the semi-circular slot 27 and the through slot 39; when the hook member 22 turns to be in contact with the stop post 39, the hook member 22 of the swivel base 14 will be stopped at a given angle. One side of the stop post 39 is furnished with a reinforced rib 40. After the outer cover 13 is fitted to the socket body 12, the side wall 42 of the reinforced rib 40 will be in contact with the inner surface 33 of the socket body 12 so as to reinforce the strength of the stop post 39 for stopping the hook member 22. As a result of the stop post, the hook member 22 would not disengage from the socket body 12 upon the hook member moving in the semi-circular slot 27.

Figure 4:
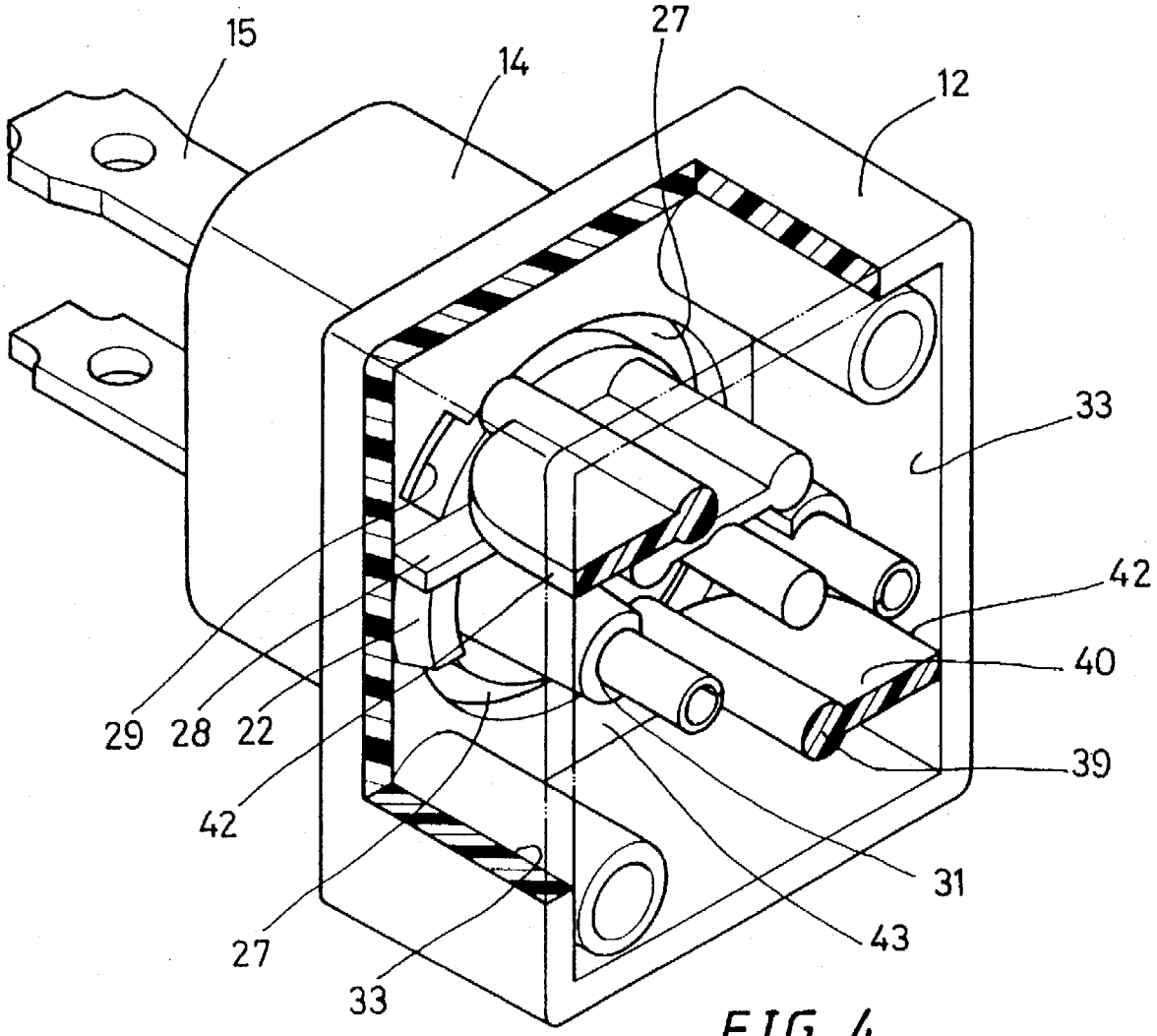
FIG. 4 is a fragmental section view of the present invention, showing the structure relation between the swivel base and the socket body.
Figure 6:
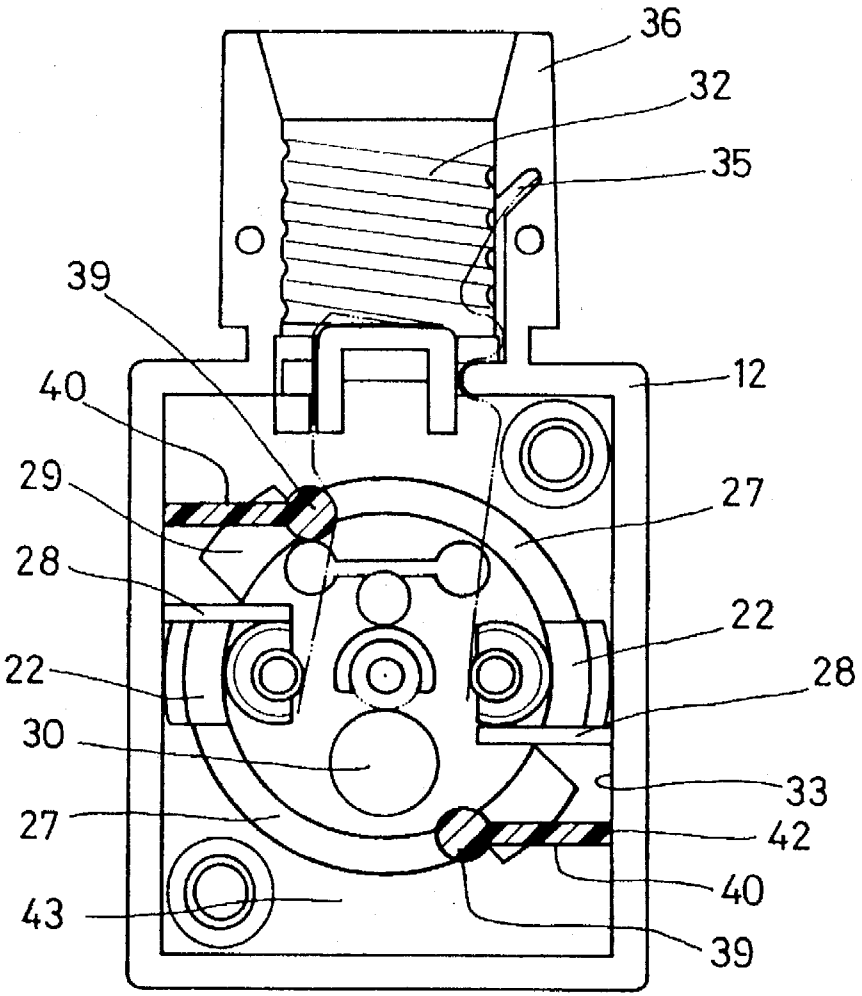
FIG. 6 is a sectional view of the present invention, showing another positioning relation between the hook and the bottom surface.
Figure 5:
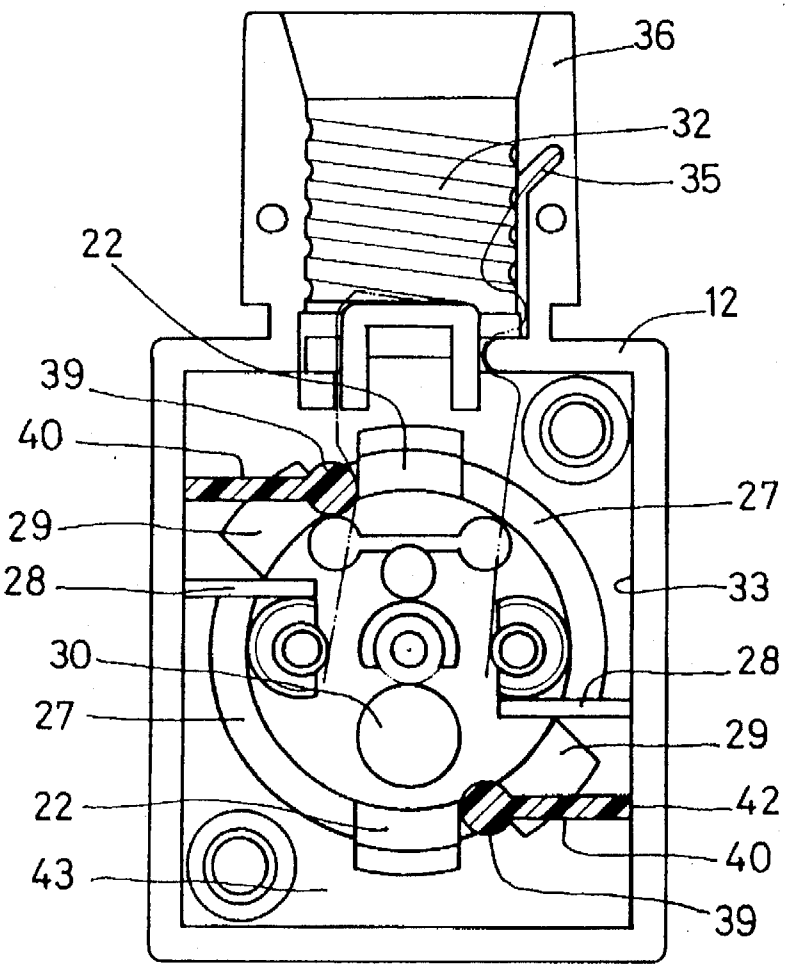
FIG. 5 is a sectional view of the present invention, showing the positioning relation between the hook and the bottom surface.

Referring to FIGS. 4 to 6, after the swivel base 14 is plugged into the semi-circular slot 27 in the bottom surface 43 of the socket body 12, and the outer cover 13 is also assembled to the socket body 12, the ends of the stop posts 39 on the outer cover 13 will be set in a space between the semi-circular slot 27 and the through slot 39 to prevent the hook member 22 from returning to the through slot 29. In order to have the swivel base 14 turned at an angle of 90 degrees, the space between the stop flange 28 and the stop post 39 is sufficient for receiving a hook member 22. If the power outlet on a wall is a horizontal type as shown in FIGS. 1 and 5, the two copper plugs 15 of the swivel base 14 can be turned into a horizontal position, while the hook members 22 in the semi-circular slots 27 will be turned into a vertical position; then, the hook members 22 will be stopped with the stop posts 39 and the reinforced ribs 40 respectively. If the power outlet on a wall is a vertical type as shown in FIGS. 2 and 6, the two copper plugs 15 of the swivel base 12 can be turned into a vertical position, and the hook members 22 will be stopped in place with the stop flange 28.

In the socket body 12, the through slot 29 at one end of the semi-circular slot 27 is used to have the hook member 22 of the swivel base 14 insert through; one end of the semi-circular slot 27 has a stop flange 28 for positioning the hook member 22. The stop posts 39 and the reinforced ribs 40 thereof in the outer cover 13 extend into a space between the through slot 29 and the semi-circular slot 27 for preventing the hook member 27 from being disengaged from the semi-circular slot 27, i.e., to provide a limited angle of the swivel base 14.

According to the aforesaid description of the embodiment, the features and structure of the present invention have been disclosed completely; it is apparent that considerable improvement has been made in the present invention, and it is never anticipated by any one who is skilled in such art; therefore, the present invention is deemed unique in terms of structure.

I claim:

1. A swivel plug structure with a bulb socket comprising:

a socket body having a bulb socket; a hole in a center of a wall surface of said socket body for receiving power wires; two symmetrical semi-circular slots in said wall surface, one end of each of said semi-circular slots having a stop flange and an opposite end of each of said semi-circular slots having a through slot;

a swivel base movably attached to said socket body, the base having a disk member with two symmetrical hook members extending therefrom configured to pass through the through slot in said socket body so as to engage said semi-circular slots so as to movably connect the swivel base to the socket body, said swivel base having electrical plugs, electrically connected to two symmetrical contact slots respectively; and two power wires connected with said two contact slots passing through said round hole in said socket body and connected to said bulb socket; and an outer cover attached to said socket body, said outer cover having two symmetrical stop posts each extending into said socket body adjacent to a juncture of said through slot and said semi-circular slot so as to prevent said hook member from extending said through hole once it has passed into said semi-circular slot.

2. The swivel plug structure with a bulb socket as claimed in claim 1, wherein said hook members on said disk member of said swivel base each include a neck portion and a hook portion, the height of said neck portion from the disk member being at least equal to the thickness of said wall surface of said socket body having the semi-circular slots; and said hook portion extends on one side from said neck portion; whereby said hook member passes through said through slot and then when the swivel base is turned, said neck portions engage said semi-circular slots, so as to movably attach the swivel body to said socket body.

3. The swivel plug structure with a bulb socket as claimed in claim 1, wherein said two stop posts on said outer cover each comprise a reinforced ribs in contact with an inner surface of said socket body.

* * * * *